US010986710B2

(12) United States Patent
Chen

(10) Patent No.: US 10,986,710 B2
(45) Date of Patent: Apr. 20, 2021

(54) CIRCUIT, SYSTEM AND METHOD FOR ADJUSTING LUMINANCE OF BACKLIGHT, BACKLIGHT AND DISPLAY DEVICE

(71) Applicant: BOE Technology Group Co., Ltd., Beijing (CN)

(72) Inventor: Shuo Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 184 days.

(21) Appl. No.: 16/330,585

(22) PCT Filed: Jun. 11, 2018

(86) PCT No.: PCT/CN2018/090615
§ 371 (c)(1),
(2) Date: Mar. 5, 2019

(87) PCT Pub. No.: WO2018/228325
PCT Pub. Date: Dec. 20, 2018

(65) Prior Publication Data

US 2020/0344856 A1 Oct. 29, 2020

(30) Foreign Application Priority Data

Jun. 14, 2017 (CN) ..... 201710447956.X

(51) Int. Cl.
*H05B 45/12* (2020.01)
*H05B 45/46* (2020.01)
*G09G 3/34* (2006.01)

(52) U.S. Cl.
CPC ..... *H05B 45/12* (2020.01); *G09G 3/3406* (2013.01); *H05B 45/46* (2020.01); *G09G 2360/145* (2013.01)

(58) Field of Classification Search
None
See application file for complete search history.

(56) References Cited

U.S. PATENT DOCUMENTS

2014/0098079 A1* 4/2014 Takayanagi ..... G09G 3/3426 345/207
2014/0340295 A1 11/2014 Zhang et al.
(Continued)

FOREIGN PATENT DOCUMENTS

CN 101281730 A 10/2008
CN 101281733 A 10/2008
(Continued)

OTHER PUBLICATIONS

First Office Action and English language translation, CN Application No. 201710447956.X, dated Aug. 29, 2018, 13 pp.
(Continued)

*Primary Examiner* — Dedei K Hammond
(74) *Attorney, Agent, or Firm* — Myers Bigel, P.A

(57) ABSTRACT

A circuit for adjusting a luminance of a backlight is provided. The backlight includes a plurality of partitions that are independent of one another. Each of the partitions includes a plurality of light emitting diodes (LEDs) arranged in an array and connected in series. The circuit includes a plurality of LED drivers each configured to supply a respective drive current to the plurality of LEDs of a respective one of the plurality of partitions, and a plurality of programmable voltage generators configured to receive respective control commands and to supply respective reference voltages to the plurality of LED drivers based on the respective control commands. Each of the LED drivers is further configured to set a level of the drive current supplied by the LED driver in response to the reference voltage supplied to the LED driver.

18 Claims, 4 Drawing Sheets

(56) References Cited

U.S. PATENT DOCUMENTS

| | | | | |
|---|---|---|---|---|
| 2015/0365621 | A1 | 12/2015 | Zhang et al. | |
| 2016/0165681 | A1* | 6/2016 | Nankil | H05B 45/10 315/291 |
| 2016/0293115 | A1* | 10/2016 | Yamashita | G09G 3/3406 |
| 2016/0335957 | A1 | 11/2016 | Fu et al. | |
| 2018/0092170 | A1 | 3/2018 | Li | |

FOREIGN PATENT DOCUMENTS

| | | | |
|---|---|---|---|
| CN | 201936713 | U | 8/2011 |
| CN | 102625065 | A | 8/2012 |
| CN | 103280191 | A | 9/2013 |
| CN | 104159365 | A | 11/2014 |
| CN | 104505055 | A | 4/2015 |
| CN | 105336297 | A | 2/2016 |
| CN | 105469746 | A | 4/2016 |
| CN | 105592595 | A | 5/2016 |
| CN | 107025885 | A | 8/2017 |
| KR | 10-2008-0032440 | A | 4/2008 |
| KR | 10-2008-0033001 | A | 4/2008 |

OTHER PUBLICATIONS

International Search Report and Written Opinion of the International Searching Authority (with English language translation of Written Opinion), International Application No. PCT/CN2018/090615, dated Aug. 1, 2018, 15 pp.

First Office Action and English language translation, CN Application No. 201710447956.X, dated Sep. 29, 2018, 13 pp.

* cited by examiner

CIRCUIT, SYSTEM AND METHOD FOR ADJUSTING LUMINANCE OF BACKLIGHT, BACKLIGHT AND DISPLAY DEVICE

CROSS-REFERENCE TO RELATED APPLICATIONS

The present application is a 35 U.S.C. 371 national stage application of PCT International Application No. PCT/CN2018/090615, filed on Jun. 11, 2018, which claims the benefit of Chinese Patent Application No. 201710447956.X filed on Jun. 14, 2017, the contents of which are incorporated herein by reference in their entireties. The above-referenced PCT International Application was published in the Chinese language as International Publication No. WO 2018/228325 A1 on Dec. 20, 2018.

TECHNICAL FIELD

The present disclosure relates to the field of display technologies, and more particularly to a circuit, system and method for adjusting a luminance of a backlight.

BACKGROUND

As an integral part of a liquid crystal display, a backlight module typically includes a backlight and a driving circuit for driving the backlight. For large size liquid crystal displays, the backlight typically includes multiple partitions each including a plurality of light emitting diodes (LEDs) as the light sources. In operation, there may be differences in the luminance of different partitions of the backlight.

SUMMARY

In accordance with an aspect of the present disclosure, a circuit for adjusting a luminance of a backlight is provided. The backlight comprises a plurality of partitions independent of each other. Each of the partitions comprises a plurality of light emitting diodes (LEDs) arranged in an array and connected in series. The circuit comprises: a plurality of LED drivers each configured to supply a respective drive current to the plurality of LEDs of a respective one of the plurality of partitions; and a plurality of programmable voltage generators configured to receive respective control commands and to supply respective reference voltages to the plurality of LED drivers based on the respective control commands. Each of the LED drivers is further configured to set a level of the drive current supplied by the LED driver in response to the reference voltage supplied to the LED driver.

In some embodiments, each of the LED drivers has a first terminal for outputting an internal reference voltage and a second terminal for receiving the reference voltage supplied to the LED driver. Each of the programmable voltage generators comprises a resistor and a digital potentiometer that are connected in series between the first terminal and a ground terminal via the second terminal. The digital potentiometer is configured to set the reference voltage supplied by the programmable voltage generator by changing a resistance of the digital potentiometer in response to the control command received by the programmable voltage generator.

In some embodiments, the resistor is connected between the first terminal and the second terminal, and the digital potentiometer is connected between the second terminal and the ground terminal.

In some embodiments, the digital potentiometer is connected between the first terminal and the second terminal, and the resistor is connected between the second terminal and the ground terminal.

In some embodiments, the plurality of programmable voltage generators comprises at least one programmable voltage source configured to generate the respective reference voltages in response to the respective control commands.

In accordance with another aspect of the present disclosure, a system for adjusting a luminance of a backlight is provided. The backlight comprises a plurality of partitions independent of each other. Each of the partitions comprises a plurality of light emitting diodes (LEDs) arranged in an array and connected in series. The system comprises: a luminance meter configured to measure respective luminances of the plurality of partitions of the backlight; a controller configured to generate respective control commands based on the measured respective luminances and a target luminance; and a circuit comprising: a plurality of LED drivers each configured to supply a respective drive current to the plurality of LEDs of a respective one of the plurality of partitions; and a plurality of programmable voltage generators configured to receive the respective control commands and to supply respective reference voltages to the plurality of LED drivers based on the respective control commands. Each of the LED drivers is further configured to set a level of the drive current supplied by the LED driver in response to the reference voltage supplied to the LED driver.

In some embodiments, the controller is further configured to: receive a first input indicative of the measured respective luminances and a second input indicative of the target luminance; determine whether the measured respective luminances are same as the target luminance; and responsive to a determination that at least one of the measured respective luminances is different from the target luminance, generating, for the plurality of programmable voltage generators, the respective control commands based on differences between the measured respective luminances and the target luminance, the respective control commands being configured to instruct the plurality of programmable voltage generators to adjust the respective reference voltages supplied to the plurality of LED drivers such that respective luminances of the plurality of partitions are substantially equal to the target luminance.

In some embodiments, the circuit is local to the backlight, the controller is located remotely from the backlight, and the system further comprises a signal converter configured to program the respective control commands generated by the controller into the plurality of programmable voltage generators.

In some embodiments, the luminance meter comprises a charge coupled device (CCD) based optical illuminometer.

In accordance with still another aspect of the present disclosure, a method for adjusting a luminance of a backlight is provided. The backlight comprises a plurality of partitions independent of each other. Each of the partitions comprises a plurality of light emitting diodes (LEDs) arranged in an array and connected in series. The method comprises: measuring respective luminances of the plurality of partitions of the backlight; generating respective control commands based on the measured respective luminances and a target luminance; and adjusting a drive current supplied to the plurality of LEDs of at least one of the plurality of partitions based on the respective control commands such that the respective luminances of the plurality of partitions are substantially equal to the target luminance.

In some embodiments, the generating the respective control commands comprises: receiving a first input indicative of the measured respective luminances and a second input indicative of the target luminance; determining whether the measured respective luminances are equal to the target luminance; and responsive to a determination that at least one of the measured respective luminances is different from the target luminance, generating the respective control commands based on differences between the measured respective luminances and the target luminance.

According to still another aspect of the present disclosure, a backlight is provided comprising: a plurality of partitions independent of each other, each of the partitions comprising a plurality of light emitting diodes (LEDs) arranged in an array and connected in series; and a circuit as described above.

In accordance with still another aspect of the present disclosure, a display device is provided, comprising a backlight as described above.

These and other aspects of the present disclosure will be apparent from and elucidated with reference to the embodiment(s) described hereinafter.

BRIEF DESCRIPTION OF THE DRAWINGS

The drawings are provided for a further understanding of the present disclosure and form a part of this disclosure. In the drawing.

DETAILED DESCRIPTION

It will be understood that, although the terms first, second, third etc. may be used herein to describe various elements, components and/or sections, these elements, components and/or sections should not be limited by these terms. These terms are only used to distinguish one element, component or section from another. Thus, a first element, component or section discussed below could be termed a second element, component or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element is referred to as being "connected to" or "coupled to" another element, it can be directly connected or coupled to the other element, or intervening elements may be present. In contrast, when an element is referred to as being "directly connected to" or "directly coupled to" another element, there are no intervening elements present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Embodiments of the present disclosure are described in detail below with reference to the accompanying drawings.

A difference in luminance between different partitions of the backlight can affect the uniformity of the luminance of the backlight as a whole, thereby affecting the display effect of a display as the final product. In view of this, the present disclosure proposes to open an interface for adjusting the luminance of the backlight to a user of the backlight (e.g., a display manufacturer) to enable the user to modify original settings of the backlight according to his or her own needs. This facilitates eliminating factory defects of the backlight and improving display quality of the display as the final product.

Figure 1:
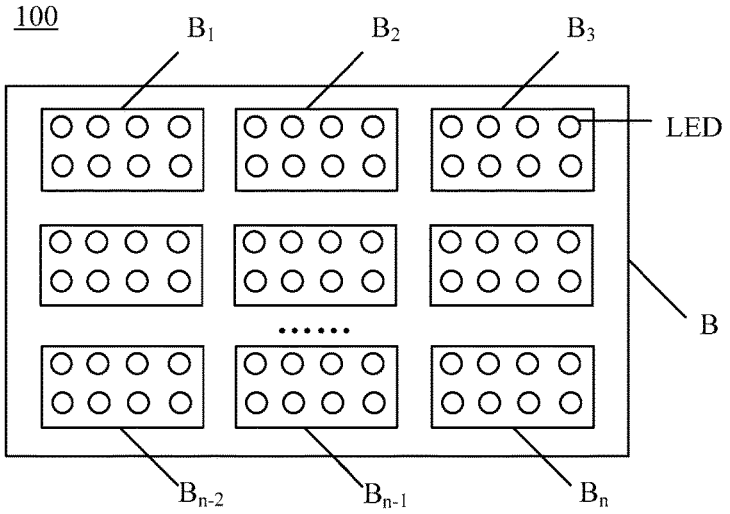
FIG. 1 is a schematic diagram of a typical display device including a backlight having a plurality of partitions.

FIG. 1 is a schematic diagram of a typical display device 100 including a backlight B having a plurality of partitions. As shown in FIG. 1, the display device 100 includes a backlight B including a plurality of mutually independent partitions $B_1$, $B_2$, $B_3$, . . . , $B_{n-2}$, $B_{n-1}$, $B_n$, each of which includes multiple light emitting diodes (LEDs) arranged in an array and connected in series. This allows for individually controllable adjustment of the luminance of the plurality of partitions $B_1$, $B_2$, $B_3$, . . . , $B_{n-2}$, $B_{n-1}$, $B_n$. It will be appreciated that the display device 100 can be any display that incorporates the backlight B as shown and described, such as a liquid crystal display, an electronic ink display, and the like. However, other details of the display device 100 are not shown in order not to obscure the subject matter of the present disclosure. It will also be understood that the arrangement of the partitions shown and the number of LEDs included in each partition are exemplary, and that other embodiments are possible.

Figure 2:
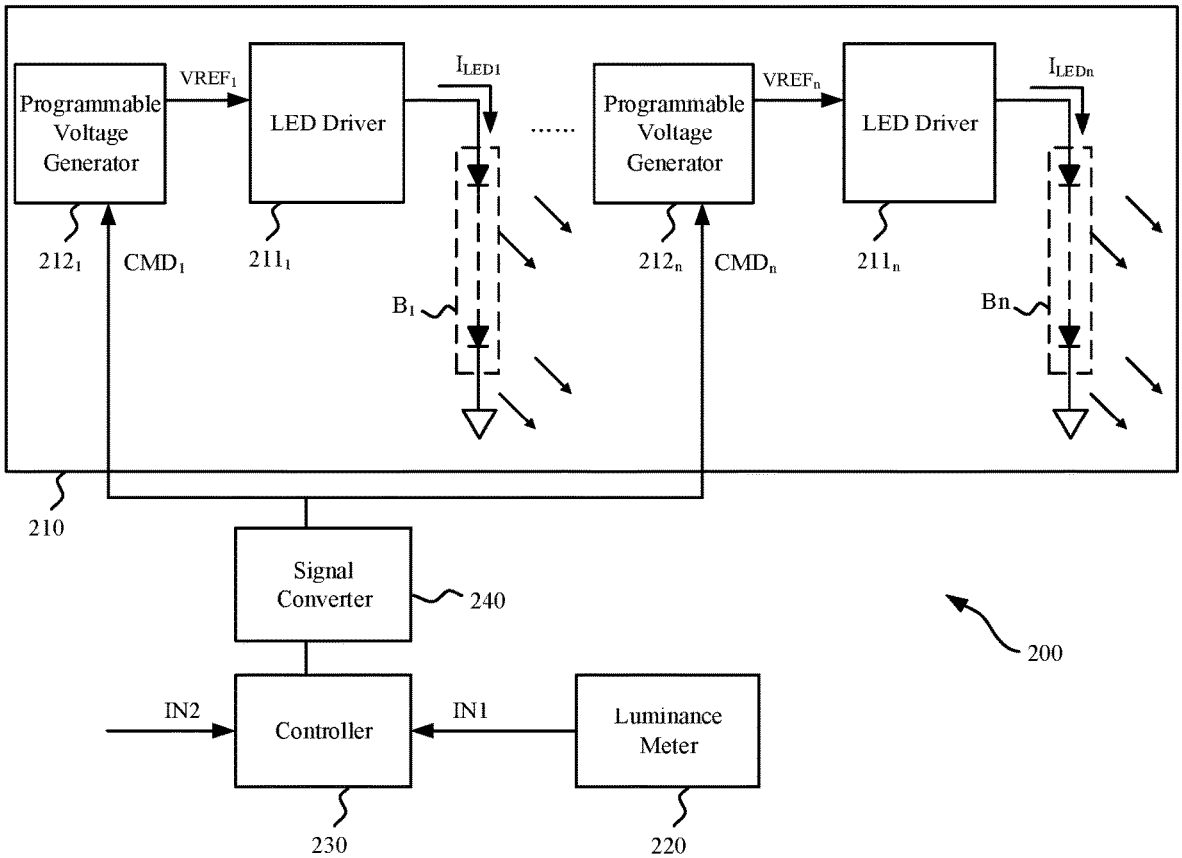
FIG. 2 is a schematic diagram of a system for adjusting a luminance of a backlight, in accordance with an embodiment of the present disclosure.

FIG. 2 is a schematic diagram of a system 200 for adjusting the luminance of a backlight, in accordance with an embodiment of the present disclosure. As shown in FIG. 2, the system 200 includes a display device 210, a luminance meter 220, and a controller 230.

The display device 210 may take the form of the display device 100 of FIG. 1 and includes a backlight including the plurality of mutually independent partitions $B_1$, $B_2$, $B_3$, . . . , $B_{n-2}$, $B_{n-1}$, $B_n$. The partitions $B_1$ and $B_n$ are shown in FIG. 2. The backlight of FIG. 2 is also provided with a circuit for adjusting the luminances of the partitions, comprising a plurality of LED drivers $\mathbf{211}_1$ . . . $\mathbf{211}_n$ and a plurality of programmable voltage generators $\mathbf{212}_1$ . . . $\mathbf{212}_n$. Specifically, the partition $B_1$ is provided with an LED driver $211_1$ and a programmable voltage generator $212_1$, and the partition $B_n$ is provided with an LED driver $211_n$ and a programmable voltage generator $212_n$. The LED drivers $211_1 \ldots 211_n$ are configured to supply respective drive currents $I_{LED1} \ldots I_{LEDn}$ to the plurality of partitions $B_1 \ldots B_n$. The programmable voltage generators $212_1 \ldots 212_n$ are configured to receive respective control commands $CMD_1 \ldots CMD_n$ and to supply respective reference voltages $VREF_1 \ldots VREF_n$ to the LED drivers $211_1 \ldots 211_n$ based on the respective control commands $CMD_1 \ldots CMD_n$. The LED drivers $211_1 \ldots 211_n$ are also configured to set the levels of respective drive currents $I_{LED1} \ldots I_{LEDn}$ in response to respective reference voltages $VREF_1 \ldots VREF_n$.

The luminance meter 220 is configured to measure respective luminances of the plurality of partitions $B_1 \ldots B_n$. Examples of the luminance meter 220 include various charge coupled device (CCD) based optical illuminometers that are commercially available. Other types of luminance meters are also possible.

The controller 230 is configured to generate the respective control commands $CMD_1 \ldots CMD_n$ based on the measured respective luminances and a target luminance. Specifically, the controller 230 receives a first input IN1 indicative of the measured respective luminances and a second input IN2 indicative of the target luminance. In some embodiments, the controller 230 may receive the first input IN1 via a data transfer interface or a human machine interface. The controller 230 may also receive the second input IN2 entered by the user via the human machine interface. Alternatively, the second input IN2 can be pre-built in a memory accessible by the controller 230. The controller 230 then determines if the measured respective luminances are equal to the target luminance. Next, in response to a determination that at least one of the measured respective luminances is different from the target luminance, the controller 230 generates, for the plurality of programmable voltage generators $212_1 \ldots 212_n$, the respective control commands $CMD_1 \ldots CMD_n$ based on the differences between the measured respective luminances and the target luminance. The respective control commands $CMD_1 \ldots CMD_n$ are configured to instruct the programmable voltage generators $212_1 \ldots 212_n$ to adjust the respective reference voltages $VREF_1 \ldots VREF_n$ supplied to the LED drivers $211_1 \ldots 211_n$ such that the respective luminances of the plurality of partitions $B_1 \ldots B_n$ are substantially equal to the target luminance.

It will be understood that the terms "equal" and "substantially equal" as used herein do not necessarily mean exactly the same, but rather allow a certain tolerance, such as ±5%. The term "controller" is used herein to describe a variety of different devices related to the operation of a backlight. The controller 230 can be implemented in a number of ways (e.g., using dedicated hardware) to perform the various functions discussed herein. A "processor" is an example of the controller 230 that employs one or more microprocessors that can be programmed using software (e.g., microcode) to perform the various functions discussed herein. The controller 230 can be implemented with or without a processor, and can also be implemented as a combination of dedicated hardware that performs some functions and a processor that performs other functions (e.g., one or more programmed microprocessors and associated circuits). Examples of the controller components that may be employed in various different embodiments of the present disclosure include, but are not limited to, conventional microprocessors, application specific integrated circuits (ASICs), and field programmable gate arrays (FPGAs).

In various implementations, the controller 230 can be associated with one or more storage media (collectively referred to herein as "memory", for example, volatile and nonvolatile computer memories, floppy disks, compact disks, optical disks, tapes etc., such as RAMs, PROMs, EPROMs, and EEPROMs). In some implementations, the storage medium can be encoded with one or more programs that, when executed on one or more processors, perform at least some of the functions discussed herein. A variety of different storage media may be fixed in the processor or may be transportable such that the one or more programs stored thereon can be loaded into the processor to implement various aspects discussed herein. The term "program" or "computer program" is used herein in a generic sense to refer to any type of computer code (e.g., software or microcode) that can be employed to program one or more processors.

In some embodiments, the circuit including the LED drivers $211_1 \ldots 211_n$ and the programmable voltage generators $212_1 \ldots 212_n$ are local to the backlight, such as integrated with the LEDs of the backlight, and the controller 230 is located remotely from the backlight, for example, separate from the display device 210. In such an embodiment, the system 200 further includes a signal converter 240 configured to program the respective control commands $CMD_1 \ldots CMD_n$ generated by the controller 230 into the programmable voltage generators $212_1 \ldots 212_n$. An example of the signal converter 240 is a programmer. In some embodiments, the controller 230 can also be local to the backlight or the display device 210, in which case the signal converter 240 is optional because the control commands $CMD_1 \ldots CMD_n$ can be programmed directly to the programmable voltage generators $212_1 \ldots 212_n$.

Figure 3A:
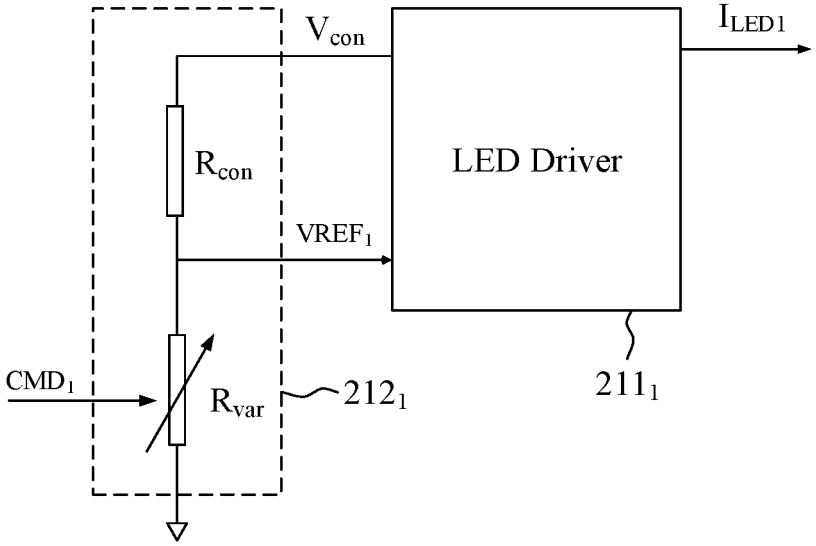
FIG. 3A is a schematic diagram of a luminance adjustment circuit for a single partition of a backlight in the system of FIG. 2.

FIG. 3A is a schematic diagram of a luminance adjustment circuit for a single partition of the backlight in the system 200 of FIG. 2. Specifically, the LED driver $211_1$ and the programmable voltage generator $212_1$ are shown in FIG. 3A.

The LED driver $211_1$ can be any commercially available LED driver chip capable of adjusting the output current $I_{LED1}$ according to the reference voltage $VREF_1$, such as the switch mode LED driver chip HV9911 from Supertex™. In the example of FIG. 3A, the HV9911 as the LED driver $211_1$ has a first terminal for outputting an internal reference voltage $V_{con}$, and a second terminal for receiving the reference voltage $VREF_1$, and the output current $I_{LED1}$ of the HV9911 and the reference voltage $VREF_1$ is proportional. More information on HV9911 can be found at www.supertex.com.

The programmable voltage generator $212_1$ is used to provide the LED driver $211_1$ with a variable reference voltage $VREF_1$. In the example of FIG. 3A, the programmable voltage generator $212_1$ includes a resistor $R_{con}$ and a digital potentiometer $R_{var}$ that are connected in series between the first terminal of HV9911 and a ground terminal via the second terminal of HV9911. Specifically, the resistor $R_{con}$ is connected between the first terminal and the second terminal, and the digital potentiometer $R_{var}$ is connected between the second terminal and the ground terminal. The digital potentiometer $212_1$ is configured to set the reference voltage $VREF_1$ by changing the resistance of the digital potentiometer $212_1$ in response to the received control command $CMD_1$. In this example, the reference voltage $VREF_1$ can be expressed as $VREF_1=(R_{var}/R_{con}+R_{var}))V_{con}$. By means of the LED driver $211_1$, the drive current $I_{LED1}$ supplied to the partition $B_1$ of the backlight will be changed in response to the control command $CMD_1$.

Figure 3B:
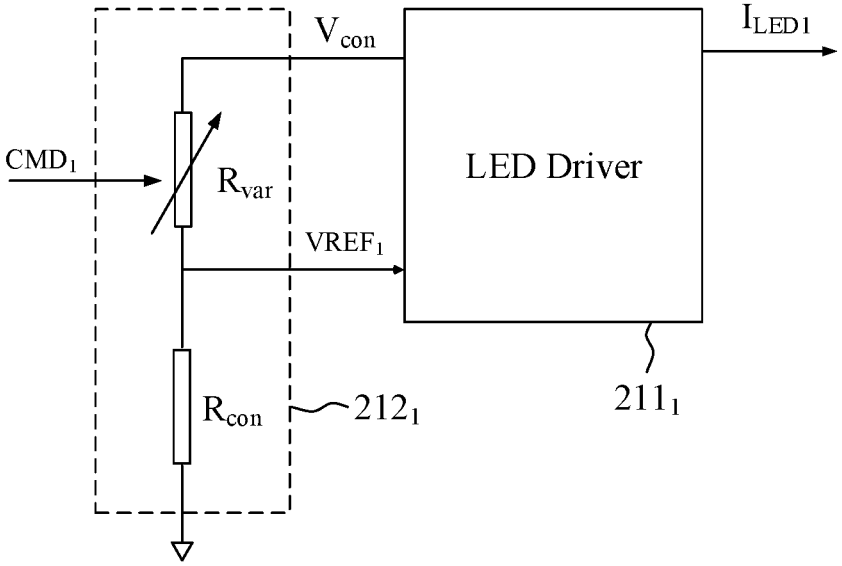
FIG. 3B is a schematic diagram of a variation of the circuit of FIG. 3A.

FIG. 3B is a schematic diagram of a variation of the circuit of FIG. 3A. The circuit of FIG. 3B is similar to the circuit of FIG. 3A except that the resistor $R_{con}$ and the digital potentiometer $R_{var}$ are now swapped. As shown in FIG. 3B, the digital potentiometer $R_{var}$ is connected between the first terminal and the second terminal of the HV9911, and the resistor $R_{con}$ is connected between the second terminal of the HV9911 and the ground terminal. In this example, the reference voltage $VREF_1$ can be expressed as $VREF_1=(R_{con}/(R_{con}+R_{var}))V_{con}$. By means of the LED driver 211$_1$, the drive current $I_{LED1}$ supplied to the partition $B_1$ of the backlight will be changed in response to the control command $CMD_1$.

Figure 3C:
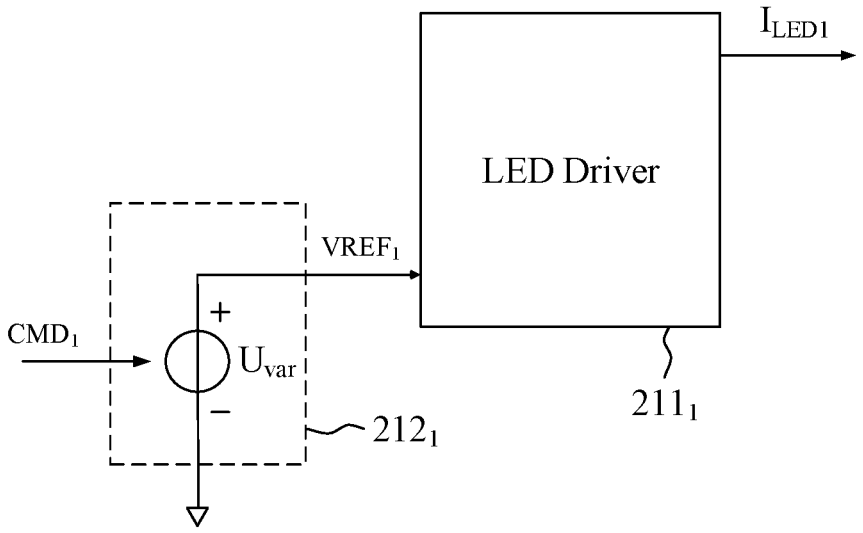
FIG. 3C is a schematic diagram of another variation of the circuit of FIG. 3A.

FIG. 3C is a schematic diagram of another variation of the circuit of FIG. 3A. In the example of FIG. 3C, the LED driver 211$_1$ can take the same form as in FIG. 3A, and the programmable voltage generator 212$_1$ is a programmable voltage source $U_{var}$. In this case, the voltage source $U_{var}$ can directly supply the reference voltage $VREF_1$ to the LED driver 211$_1$ in response to the control command $CMD_1$. One or more voltage sources $U_{var}$ can be implemented by commercially available voltage generator chips, such as the multi-channel programmable voltage generator chip ISL24853A from Intersil™. More information on the ISL24853A can be found at www.intersil.com.

Figure 4:
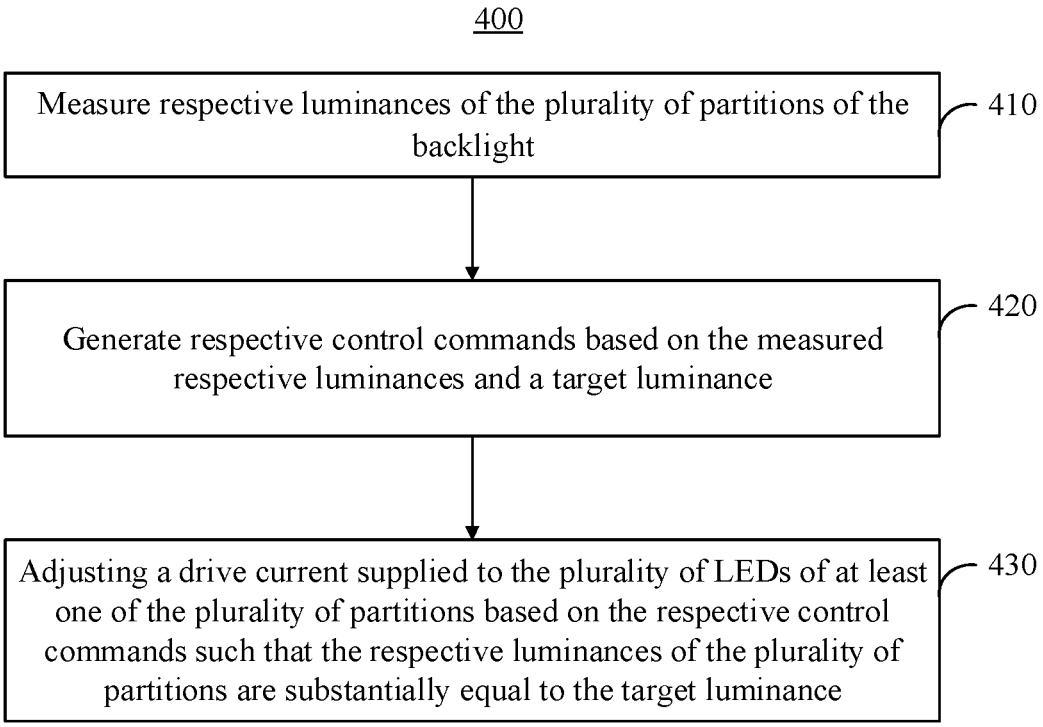
FIG. 4 is a flowchart of a method for adjusting a luminance of a backlight, in accordance with an embodiment of the present disclosure.

FIG. 4 is a flow chart of a method 400 for adjusting the luminance of a backlight, in accordance with an embodiment of the present disclosure. The method 400 can be implemented by the system 200 described above with respect to FIG. 2, wherein the backlight includes the plurality of partitions $B_1 \ldots B_n$ independent of each other, each of the partitions comprising multiple LEDs arranged in an array and connected in series.

At step 410, respective luminances of the plurality of partitions of the backlight are measured. This can be performed by the luminance meter 220 of FIG. 2.

At step 420, respective control commands are generated based on the measured respective luminances and a target luminance. This can be performed by the controller 230 of FIG. 2. In the example of FIG. 2, the control commands $CMD_1 \ldots CMD_n$ are configured to instruct the programmable voltage generators 212$_1$ . . . 212$_n$ to adjust the respective reference voltages $VREF_1 \ldots VREF_n$ supplied to the LED drivers 211$_1$ . . . 211$_n$ such that the respective luminances of the partitions $B_1 \ldots B_n$ are substantially equal to the target luminance.

At step 430, a drive current supplied to the plurality of LEDs of at least one of the plurality of partitions is adjusted according to the respective control commands such that respective luminances of the plurality of partitions are substantially equal to the target luminance. As described above, this can be performed by the programmable voltage generators 212$_1$ . . . 212$_n$ and the LED drivers 211$_1$ . . . 211$_n$ of FIG. 2.

It will be understood that in practice steps 410-430 may need to be performed repeatedly until the respective luminances of the plurality of partitions are substantially equal to the target luminance.

Figure 5:
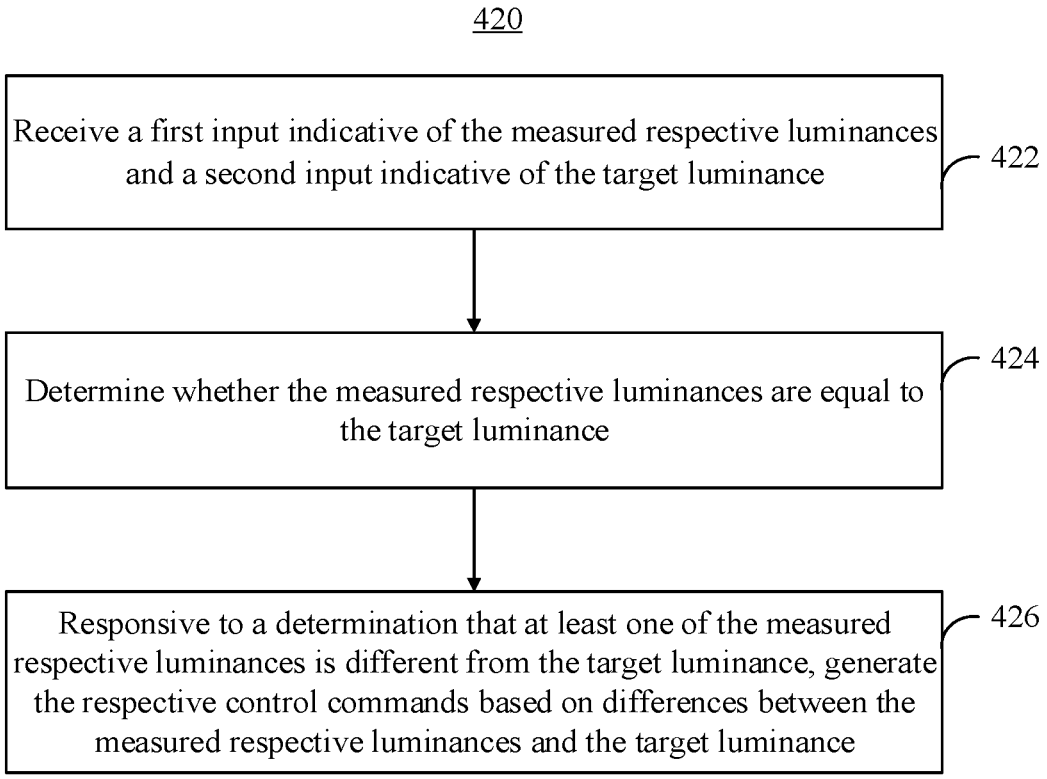
FIG. 5 is a flow chart of a step of generating a control command in the method of FIG. 4.

FIG. 5 is a flow chart of step 420 in the method 400 of FIG. 4. At step 422, a first input indicative of the measured respective luminances and a second input indicative of the target luminance are received. In the example of FIG. 2, the controller 230 may receive the measured luminance data from the luminance meter 220 via a data transfer interface such as a universal serial bus (USB) interface, a wireless or wired network interface. Alternatively or additionally, the controller 230 may receive the luminance data entered by a user via a human machine interface such as a keyboard, touch screen, or the like. The controller 230 may also receive luminance data indicative of the target luminance. At step 424, it is determined if the measured respective luminances are equal to the target luminance. At step 426, in response to a determination that at least one of the measured respective luminances is not equal to the target luminance, the respective control command are generated based on the differences between the measured respective luminances and the target luminance.

The foregoing are specific embodiments of the disclosure, but the scope of the present disclosure is not limited thereto. Variations or modifications of the disclosed embodiments can be made by those skilled in the art without departing from the scope of the disclosure. Therefore, the scope of the disclosure should be subject to the appended claims.

What is claimed is:

1. A circuit for adjusting a luminance of a backlight, the backlight comprising:

a plurality of partitions independent of each other, each of the partitions comprising a plurality of light emitting diodes (LEDs) arranged in an array and connected in series;

a plurality of LED drivers configured to supply a respective drive current to the plurality of LEDs of a respective one of the plurality of partitions; and a plurality of programmable voltage generators configured to receive respective control commands and to supply respective reference voltages to the plurality of LED drivers based on the respective control commands, wherein the plurality of LED drivers are further configured to set a level of the respective drive current supplied by the respective one of the plurality of LED drivers in response to the respective reference voltages supplied to the respective ones of the plurality of LED drivers, wherein each of the LED drivers comprises a first terminal configured to output an internal reference voltage and a second terminal configured to receive the reference voltage supplied to a corresponding one of the LED drivers, wherein each of the programmable voltage generators comprises a resistor and a digital potentiometer that are connected in series between the first terminal and a ground terminal of a respective one of the LED drivers via the second terminal of the respective one of the LED drivers, and wherein the digital potentiometer is configured to set the reference voltage supplied by a corresponding one of the programmable voltage generators by changing a resistance of the digital potentiometer of a corresponding one of the programmable voltage generators in response to a respective one of the control commands received by the corresponding one of the programmable voltage generators.

2. The circuit of claim 1, wherein the resistor of the corresponding one of the programmable voltage generators is connected between the first terminal and the second terminal of the corresponding one of the LED drivers, and wherein the digital potentiometer of the corresponding one of the programmable voltage generators is connected between the second terminal and the ground terminal of the corresponding one of the LED drivers.

3. The circuit of claim 1, wherein the digital potentiometer of the corresponding one of the programmable voltage generators is connected between the first terminal and the second terminal of the corresponding one of the LED drivers, and wherein the resistor of the corresponding one of the programmable voltage generators is connected between the second terminal and the ground terminal of the corresponding one of the LED drivers.

4. The circuit of claim 1, wherein the plurality of programmable voltage generators comprises at least one programmable voltage source configured to generate the respective reference voltages in response to the respective control commands.

5. A backlight comprising:

a plurality of partitions independent of each other, each of the partitions comprising a plurality of light emitting diodes (LEDs) arranged in an array and connected in series; and a circuit as claimed in claim 1.

6. A display device comprising the backlight of claim 5.

7. The backlight of claim 5, wherein the resistor of the corresponding one of the programmable voltage generators is connected between the first terminal and the second terminal of the corresponding one of the LED drivers, and wherein the digital potentiometer of the corresponding one of the programmable voltage generators is connected between the second terminal and the ground terminal of the corresponding one of the LED drivers.

8. The backlight of claim 5, wherein the digital potentiometer of the corresponding one of the programmable voltage generators is connected between the first terminal and the second terminal of the corresponding one of the LED drivers, and wherein the resistor of the corresponding one of the programmable voltage generators is connected between the second terminal and the ground terminal of the corresponding one of the LED drivers.

9. A system for adjusting a luminance of a backlight, the backlight comprising a plurality of partitions independent of each other, each of the partitions comprising a plurality of light emitting diodes (LEDs) arranged in an array and connected in series, the system comprising:

a luminance meter configured to measure respective luminances of the plurality of partitions of the backlight;

a controller configured to generate respective control commands based on the respective luminances that were measured and a target luminance; and a circuit comprising:

a plurality of LED drivers configured to supply a respective drive current to the plurality of LEDs of a respective one of the plurality of partitions; and a plurality of programmable voltage generators configured to receive the respective control commands and to supply respective reference voltages to the plurality of LED drivers based on the respective control commands, wherein the LED drivers are further configured to set a level of the respective drive current supplied by the respective one of the LED drivers in response to the respective one of the reference voltages supplied to the respective one of the LED drivers.

10. The system of claim 9, wherein the controller is further configured to:

receive a first input indicative of the respective luminances that were measured and a second input indicative of the target luminance;

determine whether the respective luminances that were measured are the same as the target luminance; and responsive to a determination that at least one of the respective luminances that were measured is different from the target luminance, generating, for the plurality of programmable voltage generators, the respective control commands based on differences between the respective luminances that were measured and the target luminance, wherein the respective control commands are configured to instruct the plurality of programmable voltage generators to adjust the respective reference voltages supplied to the plurality of LED drivers such that respective luminances of the plurality of partitions are substantially equal to the target luminance.

11. The system of claim 9, wherein the circuit is local to the backlight, wherein the controller is located remotely from the backlight, and wherein the system further comprises a signal converter configured to program the respective control commands generated by the controller into the plurality of programmable voltage generators.

12. The system of claim 9, wherein each of the LED drivers comprises a first terminal configured to output an internal reference voltage and a second terminal configured to receive the reference voltage supplied to a corresponding one of the LED drivers, wherein each of the programmable voltage generators comprises a resistor and a digital potentiometer that are connected in series between the first terminal and a ground terminal of a respective one of the LED drivers via the second terminal of the respective one of the LED drivers, and wherein the digital potentiometer is configured to set the reference voltage supplied by a corresponding one of the programmable voltage generators by changing a resistance of the digital potentiometer of a corresponding one of the programmable voltage generators in response to a respective one of the control commands received by the corresponding one of the programmable voltage generators.

13. The system of claim 12, wherein the resistor of the corresponding one of the programmable voltage generators is connected between the first terminal and the second terminal of the corresponding one of the LED drivers, and wherein the digital potentiometer of the corresponding one of the programmable voltage generators is connected between the second terminal and the ground terminal of the corresponding one of the LED drivers.

14. The system of claim 12, wherein the digital potentiometer of the corresponding one of the programmable voltage generators is connected between the first terminal and the second terminal of the corresponding one of the LED drivers, and wherein the resistor of the corresponding one of the programmable voltage generators is connected between the second terminal and the ground terminal of the corresponding one of the LED drivers.

15. The system of claim 9, wherein the plurality of programmable voltage generators comprises at least one programmable voltage source configured to generate the respective reference voltages in response to the respective control commands.

16. The system of claim 9, wherein the luminance meter comprises a charge coupled device (CCD) based optical illuminometer.

17. A method for adjusting the luminance of the backlight by using the system of claim 9, the method comprising:

measuring respective luminances of the plurality of partitions of the backlight by using the luminance meter;

generating respective control commands based on the respective luminances that were measured and a target luminance; and adjusting a drive current supplied to the plurality of LEDs of at least one of the plurality of partitions by the respective LED driver based on the respective control commands such that the respective luminances of the plurality of partitions are substantially equal to the target luminance.

18. The method of claim 17, wherein the generating the respective control commands comprises:

receiving a first input indicative of the respective luminances that were measured and a second input indicative of the target luminance;

determining whether the respective luminances that were measured are equal to the target luminance; and responsive to a determination that at least one of the respective luminances that were measured is different from the target luminance, generating the respective control commands based on differences between the respective luminances that were measured and the target luminance.

* * * * *